US006847166B2

(12) United States Patent
Kim et al.

(10) Patent No.: US 6,847,166 B2
(45) Date of Patent: Jan. 25, 2005

(54) PLASMA DISPLAY PANEL WITH IMPROVED BRIGHTNESS AND COLOR PURITY

(75) Inventors: Jae Sung Kim, Seoul (KR); Young Joon Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/046,285

(22) Filed: Jan. 16, 2002

(65) Prior Publication Data

US 2002/0093292 A1 Jul. 18, 2002

(30) Foreign Application Priority Data

Jan. 18, 2001 (KR) ..... 2001-2802

(51) Int. Cl.[7] ..... H01J 17/02; G09G 3/10

(52) U.S. Cl. ..... 313/610; 313/609; 315/169.4

(58) Field of Search ..... 313/610, 609, 313/611, 612, 586; 315/169.4, 169.3, 169.1; 345/74–76, 66

(56) References Cited

U.S. PATENT DOCUMENTS 6,008,582 A * 12/1999 Asano et al. ..... 313/582
6,160,348 A * 12/2000 Choi ..... 313/584
6,249,264 B1 * 6/2001 Sano et al. ..... 345/60
6,489,722 B1 * 12/2002 Yoshida et al. ..... 313/582

FOREIGN PATENT DOCUMENTS

JP Pub. 2001-155642 * 6/2001

* cited by examiner

*Primary Examiner*—Tuyet Thi Vo
(74) *Attorney, Agent, or Firm*—Fleshner & Kim, LLP

(57) ABSTRACT

An improved barrier structure of a PDP(Plasma Display Panel) is disclosed. The PDPincludes a pair of substrates opposed to each other at a prescribed interval, a plurality of address electrodes arranged on one of the substrates, a plurality of sustaining electrodes arranged on the other substrate, the sustaining electrodes intersecting the address electrodes, barriers dividing discharge cells while maintaining the prescribed interval between the substrates, and R(Red), G(Green) and B(Blue) fluorescent layers formed between the barriers in order, wherein the barriers are arranged parallel to one another between the address electrodes; a pair or pairs of the barriers corresponding to two fluorescent layers of the R, G and B fluorescent layers are in the form of a stripe and a pair of the barriers corresponding to the other fluorescent layer include bridges extending in a longitudinal direction of the sustaining electrodes as a discharge cell unit.

22 Claims, 7 Drawing Sheets

PLASMA DISPLAY PANEL WITH IMPROVED BRIGHTNESS AND COLOR PURITY

BACKGROUND OF THE INVENTION

1. Field of the Invention

The present invention relates to a plasma display panel, and more particularly, to a plasma display panel, which can improve brightness and color purity by improving a barrier structure dividing discharge cells between a front substrate and a rear substrate and make a exhausting process easy, that removes residual gas of an atmospheric pressure state contained in the PDPin a temporarily sealed condition before filled with discharge gas.

2. Background of the Related Art

FIG. 1 illustrates an exploded perspective view of a separated condition of a conventional PDP(Plasma Display Panel) and FIG. 2 illustrates a sectional view of a coupled condition of the conventional PDP. FIG. 3 illustrates a plan view of a state that stripe type barriers form cells in the conventional PDPand FIG. 4 illustrates a plan view of a state that grid type barriers form cells in the conventional PDP.

The PDPincludes a front substrate 10, which is a display screen for displaying image, and a rear substrate 20, which forms a rear surface; the front substrate and the rear substrate being coupled parallel to each other at a prescribed interval.

On a side of the front panel 10, arranged are common sustaining electrodes X and scan sustaining electrodes Y for maintaining the light emission of the cells by mutual electric discharge in one pixel, that is, sustaining electrodes, which are forms a pair respectively, including transparent electrodes (or ITO electrodes) Xa and Ya made of transparent Indium Tin Oxide material and bus electrodes Xb and Yb made of metal material.

The common sustaining electrodes X and the scan sustaining electrodes Y are covered with a dielectric layer 12 for restricting discharge current and insulating between pairs of the electrodes, and an MgO protection layer 13 is formed on an upper surface of the dielectric layer 12.

The scan sustaining electrodes Y have an addressing function for forming wall charges on the dielectric layer of the cell, to be displayed, by discharging together with address electrodes for applying data signal during an initial driving of the PDPand a discharging maintaining function for applying AC voltage after finishing the addressing.

Meanwhile, the common sustaining electrodes X perform the discharge maintaining function applying AC voltage together with the scan sustaining electrodes after finishing the addressing.

As shown in FIG. 1, the rear substrate 20 includes stripe type barriers 21 arranged parallel to one another for forming a plurality of discharge spaces, i.e., cells C, a plurality of address electrodes A arranged parallel to one another between the barriers, the address electrodes performing address discharge at portions where the address electrodes intersect the sustaining electrodes 11, and a dielectric layer 23 formed on an upper portion of the address electrodes A. Similarly, FIG. 2 illustrates a structure of the PDP, in which grid type barriers instead of the stripe type barriers are formed.

Additionally, on an upper surface of the rear substrate, namely, the surface excepting the upper end surface of the barrier 21, coated are R(Red), G(Green) and B(Blue) fluorescent layers 24 to emit visible rays for displaying image during sustaining discharge.

The operation of the PDPwill be described as follows.

Initially, if voltage of 150V~300V is supplied between the scan sustaining electrodes Y and the address electrodes A inside an arbitrary discharge cell, writing discharge is generated in the inside of the cells located between the scan sustaining electrodes Y and the address electrodes A.

After that, if discharge voltage above 150V is supplied to the corresponding common sustaining electrode X and scan sustaining electrode Y, sustaining discharge is generated between the common sustaining electrode X and the scan sustaining electrode Y in the corresponding cell, thereby maintaining the emission of the cell for a prescribed period of time.

That is, the electric discharge between the electrodes generates electric field inside the cells, and thereby, a small amount of electrons in discharge gas are accelerated. The accelerated electrons and neutral particles in gas come into collision, thereby being ionized into electrons and ions. The ionized electrons come into collision with neutral particles, and the neutral particles are rapidly ionized into electrons and ions, so that the discharge gas is made into a plasma condition, and at the same time, vacuum ultraviolet rays are generated.

If the generated ultraviolet rays excite the fluorescent layer 24 to generate visible rays and the generated visible rays are emitted to the outside through the front substrate 10, the emission of the arbitrary cells, i.e., the image display may be recognized from the outside.

The structures of the stripe type and grid type barriers of the conventional PDPhave the following advantages and disadvantages.

The PDPadopting the stripe type barriers has a path opened vertically, thereby making a manufacturing process and a exhausting process that removes residual gas of an atmospheric pressure state contained in the PDPin a temporarily sealed condition before sealing the front and rear substrates and being filled with discharge gas, easy. However, the PDPhas a smaller area where the fluorescent layer occupies in each cell, thereby reducing light-emitting efficiency, namely, reducing brightness.

On the other hand, the PDPhaving a grid type barrier structure has a larger area where the fluorescent layer occupies in each cell, thereby increasing the light-emitting efficiency, namely, the brightness. However, the exhausting process that removes residual gas of an atmospheric pressure state contained in the PDPin a temporarily sealed condition before sealing the front and rear substrates and being filled with discharge gas can not be carried out smooth, thereby delaying a period of the exhausting process. Also, due to the complicated barriers, it is difficult to manufacture the PDP.

SUMMARY OF THE INVENTION

Accordingly, the present invention is directed to a PDP (Plasma Display Panel) that substantially obviates one or more problems due to limitations and disadvantages of the related art.

An object of the present invention is to provide a PDP capable of making a exhausting process easy, that removes residual gas of an atmospheric pressure state contained in the PDPin a temporarily sealed condition before sealing front and rear substrates and being filled with discharge gas.

Another object of the present invention is to provide a PDPcapable of increasing the light-emitting efficiency, namely, the brightness, by having a larger area where a fluorescent layers occupies.

A further object of the present invention is to provide a PDPcapable of improving color purity by adjusting a luminous rate of R, G and B fluorescent layers.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a PDP(Plasma Display Panel) includes a pair of substrates opposed to each other at a prescribed interval, a plurality of address electrodes arranged on one of the substrates, a plurality of sustaining electrodes arranged on the other substrate, the sustaining electrodes intersecting the address electrodes, barriers dividing discharge cells while maintaining the prescribed interval between the substrates, and R(Red), G(Green) and B(Blue) fluorescent layers formed between the barriers in order, wherein the barriers are arranged parallel to one another between the address electrodes; a pair or pairs of the barriers corresponding to one or two fluorescent layers of the R, G and B fluorescent layers include bridges in every discharge cell, each bridge extending in a longitudinal direction of the sustaining electrodes.

It is preferable that one of the fluorescent layers is the B fluorescent layer.

It is preferable that the other two of the fluorescent layers are the R and B fluorescent layers.

In another aspect of the present invention, a PDP(Plasma Display Panel) includes a pair of substrates opposed to each other at a prescribed interval, a plurality of address electrodes arranged on one of the substrates, a plurality of sustaining electrodes arranged on the other substrate, the sustaining electrodes intersecting the address electrodes, barriers dividing discharge cells while maintaining the prescribed interval between the substrates, and R(Red), G(Green) and B(Blue) fluorescent layers formed between the barriers in order, wherein the barriers are arranged parallel to one another between the address electrodes; pairs of the barriers corresponding to the R and B fluorescent layers include bridges in every discharge cell, each bridge extending in a longitudinal direction of the sustaining electrodes, and wherein a bridge interval in the B discharge cell is wider than that in the R discharge cell.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Figure 1:
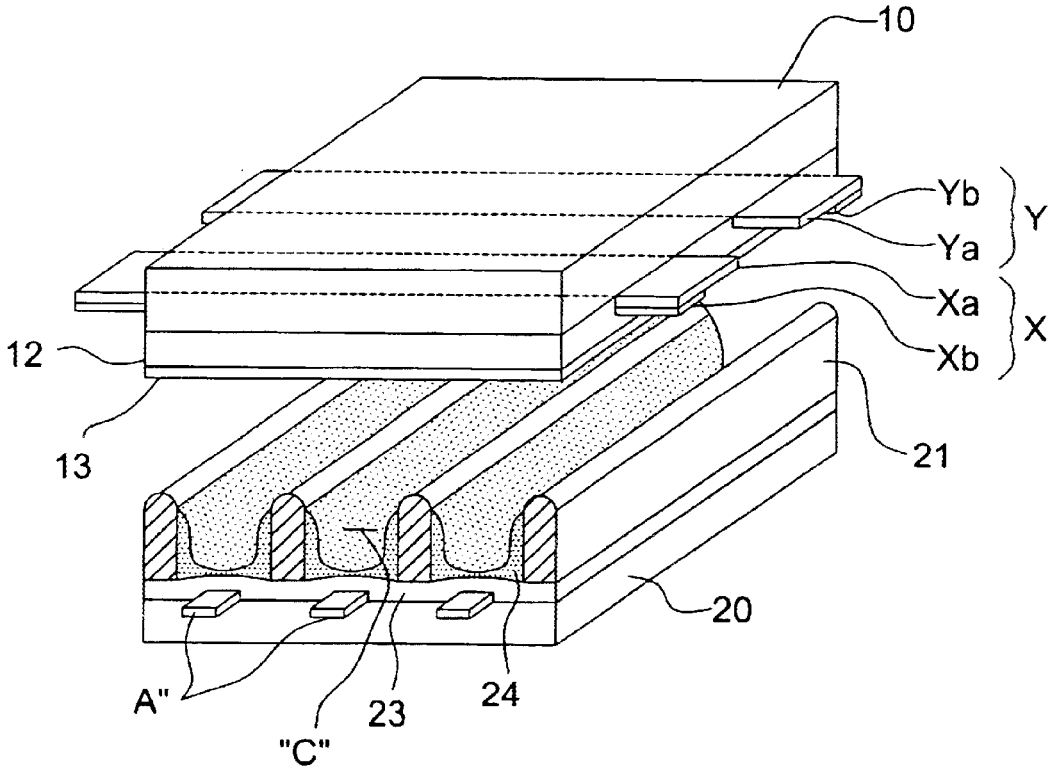
PRIOR ART FIG. 1
FIG. 1 illustrates an exploded perspective view of a conventional PDP(Plasma Display Panel) adopting a stripe type barrier.

Reference will now be made in detail to the preferred embodiments of the present invention, examples of which are illustrated in the accompanying drawings.

For convenience, like reference characters designate corresponding parts throughout several views.

Figure 2:
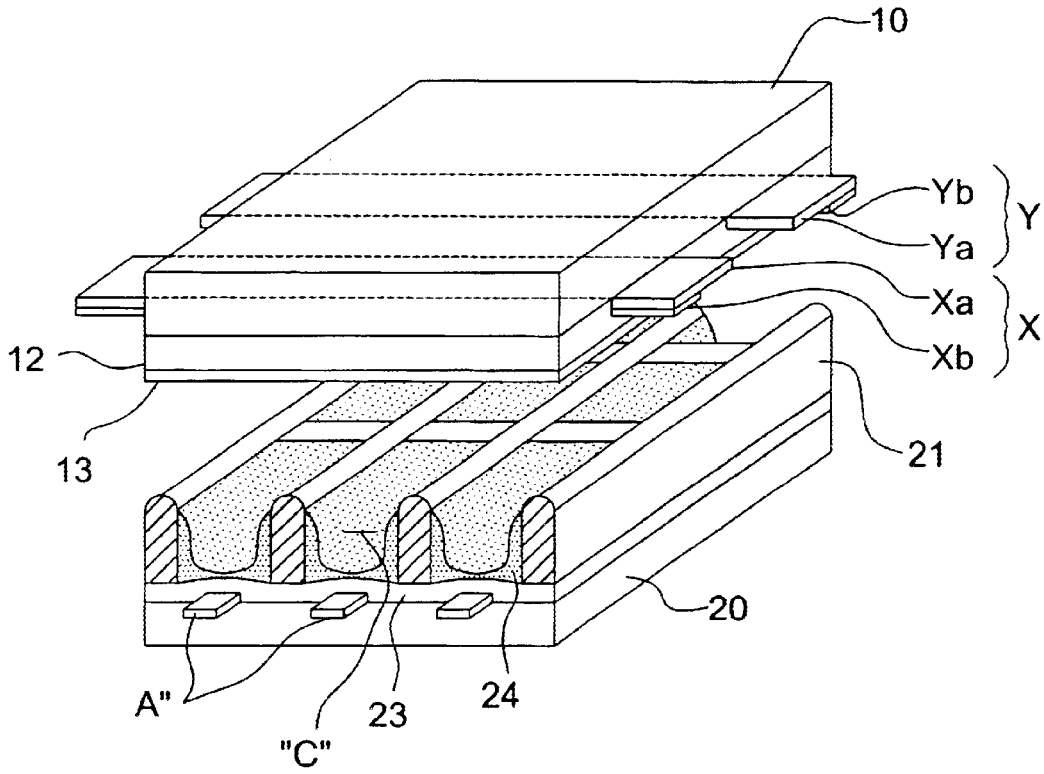
PRIOR ART FIG. 2
FIG. 2 illustrates a sectional view showing a coupled state of the PDPof FIG. 1 adopting a grid type barrier.

As shown in FIGS. 1 and 2, a PDP(Plasma Display Panel) applied in the present invention includes a front substrate 10, which is a display screen for displaying image, and a rear substrate 20, which forms a rear surface; the front substrate and the rear substrate being coupled parallel to each other at a prescribed interval.

On a side of the front panel 10, arranged are common sustaining electrodes X and scan sustaining electrodes Y for maintaining the light emission of the cells by mutual electric discharge in one pixel, that is, sustaining electrodes, which are forms a pair respectively, including transparent electrodes (or ITO electrodes) Xa and Ya made of transparent ITO material and bus electrodes Xb and Yb made of metal material.

Figure 5:
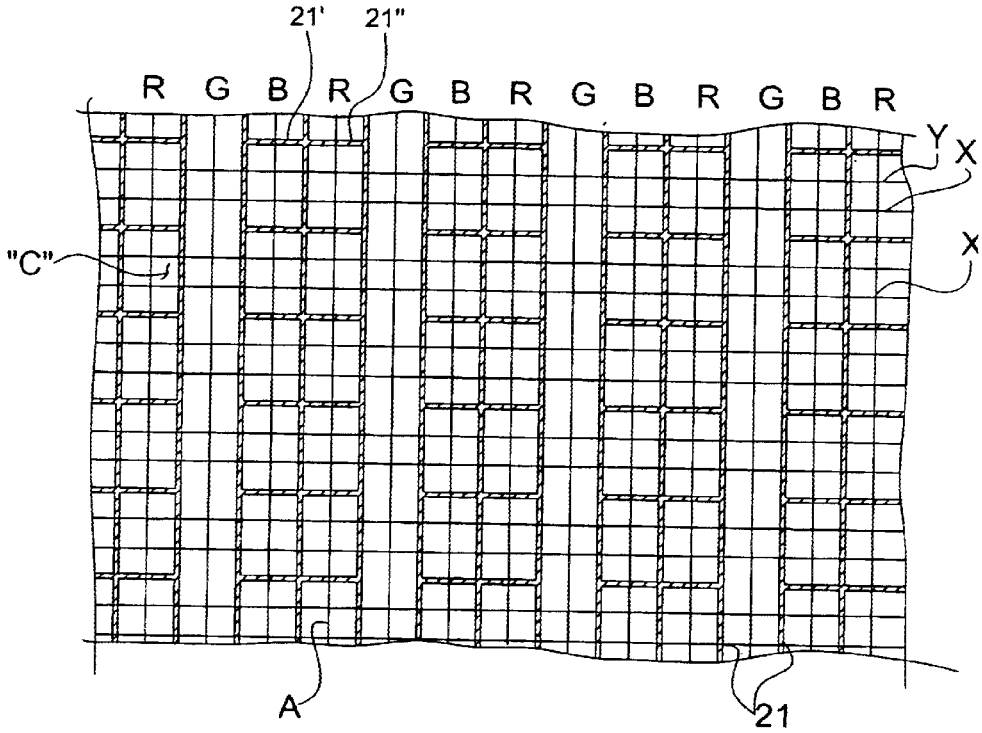
FIG. 5 illustrates a plan view showing a state that a bridge is mounted on stripe type barriers according to a first preferred embodiment of the present invention.

As shown in FIG. 5, stripe type barriers 21 are arranged parallel to one another for forming a plurality of discharge spaces, i.e., cells C, and a plurality of address electrodes A performing an address discharge at portions where the address electrodes intersect the sustaining electrodes (X, Y) are arranged parallel between the barriers.

Between the stripe barriers, coated are R(Red), G(Green) and B(Blue) fluorescent layers. Bridges 21' and 21" are formed between two barriers dividing the B and R fluorescent layers. The bridges 21' and 21" are formed lower than the stripe barriers 21 and the fluorescent layers are coated on the bridges, so that the coated area of the fluorescent layers is relatively wider. Of course, the height of the bridges 21' and 21" may be equal to that of the stripe type barriers 21, however, it is disadvantageous in a exhausting process or a fluorescent layer forming process.

Figure 3:
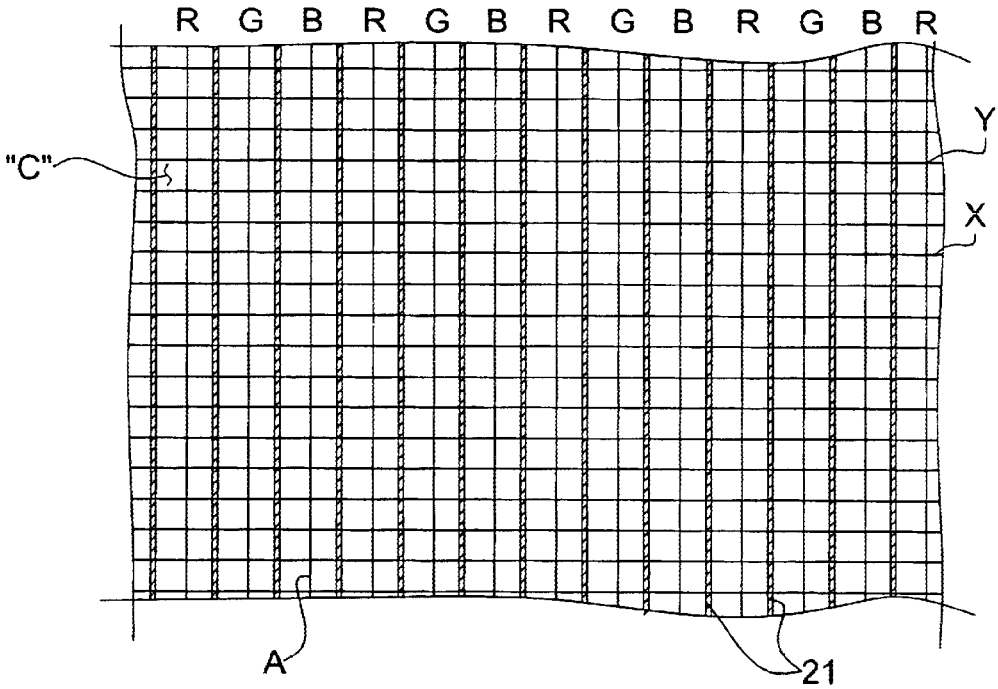
PRIOR ART FIG. 3
FIG. 3 illustrates a pattern of the stripe type barrier of the PDPof FIG. 1.
Figure 4:
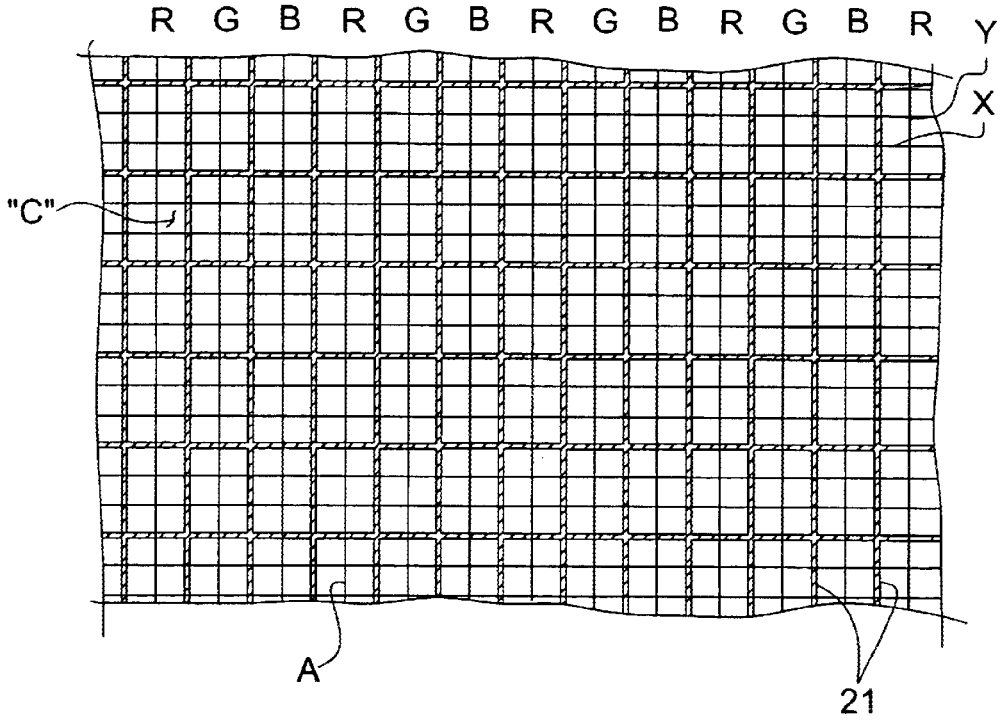
PRIOR ART FIG. 4
FIG. 4 illustrates a pattern of the grid type barrier of the PDPof FIG. 2.

As shown in FIG. 4, the present invention can provide exhausting efficiency better than general grid type barrier structures and improve brightness by having the coated area of the fluorescent layers wider than that of the stripe type barrier structure of FIG. 3.

Furthermore, the present invention can generally improve color purity by increasing the coated area of the R and B fluorescent layers having the brightness efficiency relatively less.

Figure 6:
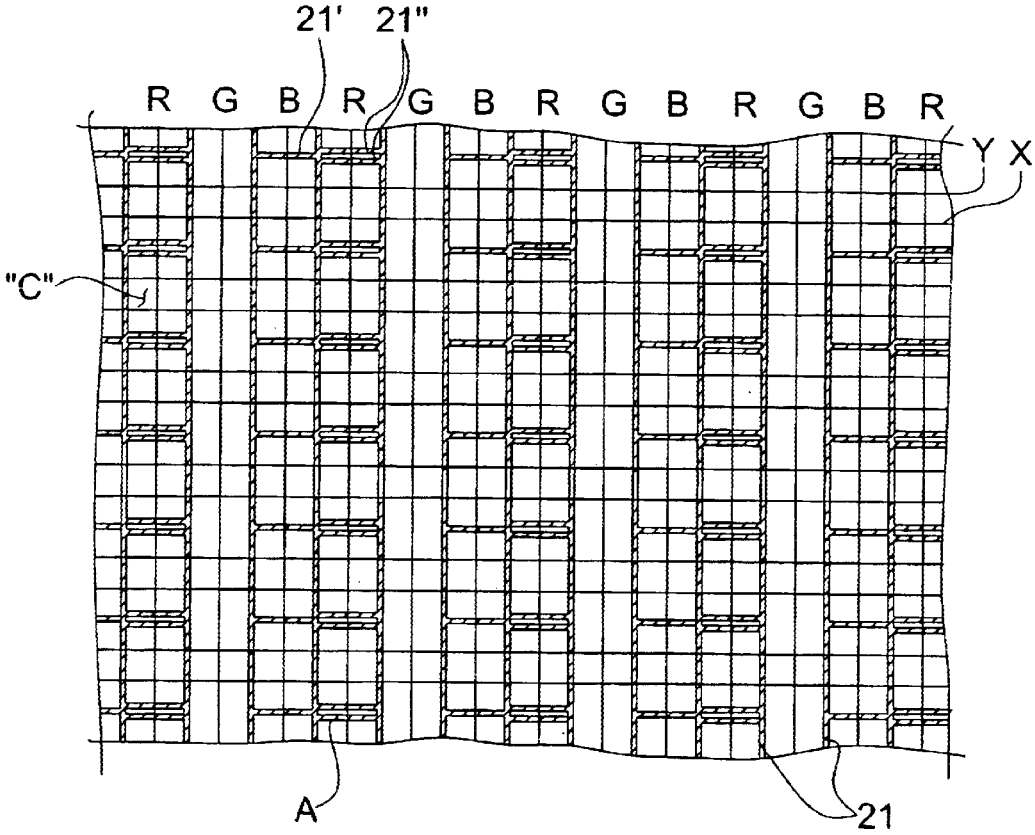
FIG. 6 illustrates a plan view a plan view showing a state that a bridge is mounted on stripe type barriers according to a second preferred embodiment of the present invention.

FIG. 6 illustrates a structure of a PDPaccording to another preferred embodiment of the present invention. In the embodiment, one bridge 21' as a cell unit is arranged between the stripe barriers 21 dividing the B fluorescent layer and two bridges 21" as a cell unit are arranged between the stripe barriers dividing the R fluorescent layer. Therefore, on the basis of one cell, a bridge interval corresponding to the R fluorescent layer is smaller than that corresponding to the B fluorescent layer. It is to vary the coated area of each fluorescent layer for compensating a difference in the light-emitting efficiency between the B and R fluorescent layers. That is, in FIG. 6, the bridge corresponding to the R fluorescent layer is formed double to reduce the bridge interval and the R fluorescent layer is coated only on a wall surface without coating on an upper surface of the bridge adjacent to the cell C. If the fluorescent layer is coated also on the upper surfaces of two bridges between the cells C, the PDPhas the coated area relatively wider, thereby lowering color purity.

That is, in case that the fluorescent layer is coated also on the upper surface of the bridge 21" between the cells C, one bridge as the cell unit is arranged between the stripe type barriers 21 dividing the R fluorescent layer and two bridges 21" as the cell unit are arranged between the stripe type barriers dividing the B fluorescent layer.

Figure 7:
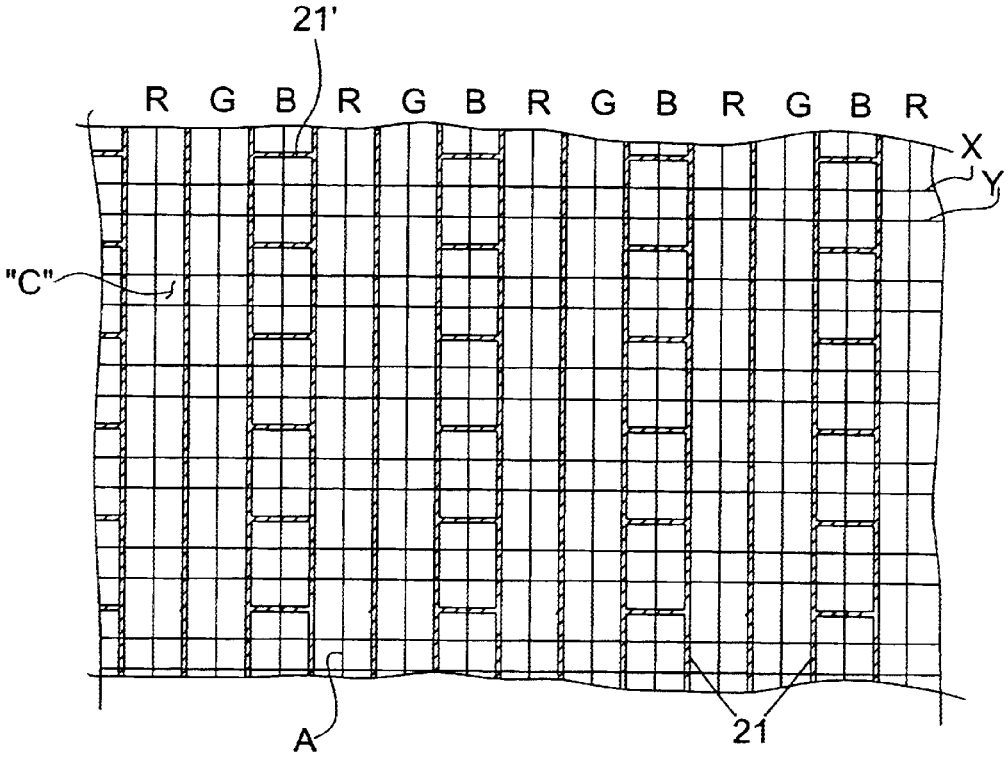
FIG. 7 illustrates a plan view a plan view showing a state that a bridge is mounted on stripe type barriers according to a third preferred embodiment of the present invention.

FIG. 7 illustrates a further preferred embodiment of the present invention. In FIG. 7, the barriers dividing the G and R fluorescent layers are formed in a stripe and the barriers dividing the B fluorescent layer are formed in a grid. As described above, the present invention can improve the color purity and discharge efficiency by widening the coated area of the B fluorescent layer having the lowest light-emitting efficiency.

The operation of the PDPadopting the barrier structure according to the present invention is the same as the conventional PDP, and therefore, its description will be omitted.

As set forth above, the present invention can make the exhausting process easy, that removes residual gas of an atmospheric pressure state contained in the PDPin a temporarily sealed condition before sealing the front and rear substrates and being filled with discharge gas, and improve the light-emitting efficiency, namely brightness, because the area occupied by the fluorescent layers is wider.

Moreover, the present invention can improve the color purity by adjusting a light-emitting rate of the R, G and B fluorescent layers by improving the shape of the barriers.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A PDP (Plasma Display Panel) comprising a pair of substrates opposed to each other at a prescribed interval, a plurality of address electrodes arranged on one of the substrates, a plurality of sustaining electrodes arranged on the other substrate, the sustaining electrodes intersecting the address electrodes, barriers dividing discharge cells while maintaining the prescribed interval between the substrates, and R (Red), G (Green) and B (Blue) fluorescent layers formed between the barriers in order, wherein the barriers are arranged parallel to one another between the address electrodes; pairs of the barriers corresponding to two fluorescent layers of the R, G and B fluorescent layers are in the form of a stripe without bridges and a pair of the barriers corresponding to the other fluorescent layer include bridges extending in a longitudinal direction of the sustaining electrodes as a discharge cell unit.

2. The PDP according to claim 1, wherein the other fluorescent layer is the B fluorescent layer.

3. The PDP according claim 1, wherein the bridge is lower than the stripe type barrier.

4. A PDP (Plasma Display Panel) comprising a pair of substrates opposed to each other at a prescribed interval, a plurality of address electrodes arranged on one of the substrates, a plurality of sustaining electrodes arranged on the other substrate, the sustaining electrodes intersecting the address electrodes, barriers dividing discharge cells while maintaining the prescribed interval between the substrates, and R (Red), G (Green) and B (Blue) fluorescent layers formed between the barriers in order, wherein the barriers are arranged parallel to one another between the address electrodes; a pair of the barriers corresponding to the G fluorescent layer of the R, G and B fluorescent layers are in the form of a stripe and pairs of the barriers corresponding to the R and B fluorescent layers include bridges extending in a longitudinal direction of the sustaining electrodes as a discharge cell unit, and an interval between bridges in the discharge cell corresponding to the B fluorescent layer is larger than in the discharge cell corresponding to the R fluorescent layer.

5. The PDP according to claim 4, wherein an upper surface of the bridge is not coated with the fluorescent layer.

6. A PDP (Plasma Display Panel) comprising a pair of substrates opposed to each other at a prescribed interval, a plurality of address electrodes arranged on one of the substrates, a plurality of sustaining electrodes arranged on the other substrate, the sustaining electrodes intersecting the address electrodes, barriers dividing discharge cells while maintaining the prescribed interval between the substrates, and R (Red), G (Green) and B (Blue) fluorescent layers formed between the barriers in order, wherein the barriers are arranged parallel to one another between the address electrodes; a pair of the barriers corresponding to the G fluorescent layer of the R, G and B fluorescent layers are in the form of a stripe and pairs of the barriers corresponding to the R and B fluorescent layers include bridges extending in a longitudinal direction of the sustaining electrodes as a discharge cell unit, an interval between bridges in the discharge cell corresponding to the R fluorescent layer is smaller than an interval between bridges in the discharge cell corresponding to the B fluorescent layer, and an upper surface of the bridge in the discharge cell corresponding to the R and B fluorescent layers is coated with the fluorescent layers.

7. An apparatus comprising:

a first set of discharge cells; and a second set of discharge cells, wherein:

the first set of discharge cells and the second set of discharge cells are separated by barriers;

each cell of the first set of discharge cells is separated from another adjacent cell of the first set of discharge cells by bridges; and each cell of the second set of discharge cells is contiguous with another adjacent cell of the second set of discharge cells.

8. The apparatus of claim 7, wherein the first set of cells are configured to discharge blue light.

9. The apparatus of claim 7, wherein the apparatus is an plasma display device.

10. The apparatus of claim 7, wherein the height of the bridges is less than the height of the barriers.

11. The apparatus of claim 7, wherein the second set of discharge cells are configured to discharge red light.

12. The apparatus of claim 7, comprising a third set of discharge cells, wherein:

the first set of discharge cells, the second set of discharge cells, and the third set of discharge cells are separated by barriers; and each cell of the third set of discharge cells is contiguous with another adjacent cell of the third set of discharge cells.

13. The apparatus of claim 12, wherein:

the second set of discharge cells are configured to discharge red light; and the third set of discharge cells are configured to discharge green light.

14. An apparatus comprising:

a first set of discharge cells;

a second set of discharge cells; and a third set of discharge cells, wherein:

the first set of discharge cells, the second set of discharge cells, and the third set of discharge cells are separated by barriers;

each cell of the first set of discharge cells is separated from another adjacent cell of the first set of discharge cells by bridges;

each cell of the second set of discharge cells is separated from another adjacent cell of the second set of discharge cells by bridges;

each cell of the third set of discharge cells is contiguous with another adjacent cell of the third set of discharge cells;

the surface area of each cell of the first set of cells is larger than the surface area of each cell of the second set of cells.

15. The apparatus of claim 14, wherein:

each cell of the first set of discharge cells is separated from another adjacent cell of the first set of discharge cells by a single bridge; and each cell of the second set of discharge cells is separated from another adjacent cell of the first set of discharge cells by at least two bridges.

16. The apparatus of claim 14, wherein the first set of cells are configured to discharge blue light.

17. The apparatus of claim 14, wherein the second set of discharge cells are configured to discharge red light.

18. The apparatus of claim 14, wherein the third set of discharge cells are configured to discharge green light.

19. The apparatus of claim 14, wherein the apparatus is an plasma display device.

20. The apparatus of claim 14, wherein the height of the bridges is less than the height of the barriers.

21. A PDP (Plasma Display Panel) comprising a pair of substrates opposed to each other at a prescribed interval, a plurality of address electrodes arranged on one of the substrates, a plurality of sustaining electrodes arranged on the other substrate, the sustaining electrodes intersecting the address electrodes, barriers dividing discharge cells while maintaining the prescribed interval between the substrates, and R (Red), G (Green) and B (Blue) fluorescent layers formed between the barriers in order, wherein the barriers are arranged parallel to one another between the address electrodes; a pair of the barriers corresponding to one of the R, G and B fluorescent layers are in the form of a stripe without bridges and pairs of the barriers corresponding to the other two fluorescent layers include bridges extending in a longitudinal direction of the sustaining electrodes as a discharge cell unit.

22. The PDP according to claim 21, wherein the two fluorescent layers are R and B fluorescent layers.

* * * * *